US005252032A

United States Patent [19]

Iwanami et al.

[11] Patent Number: 5,252,032

[45] Date of Patent: Oct. 12, 1993

[54] VARIABLE CAPACITY SWASH PLATE TYPE COMPRESSOR

[75] Inventors: Shigeki Iwanami; Mikio Matsuda, both of Okazaki, Japan

[73] Assignee: Nippon Soken, Inc., Nishio, Japan

[21] Appl. No.: 911,051

[22] Filed: Jul. 9, 1992

[30] Foreign Application Priority Data

Jul. 16, 1991 [JP] Japan ..... 3-175332

[51] Int. Cl.[5] ..... F04B 1/26

[52] U.S. Cl. ..... 417/222.1; 417/269; 92/12.2

[58] Field of Search ..... 417/222 R, 269, 270; 92/12.2

[56] References Cited

U.S. PATENT DOCUMENTS 4,061,443 12/1977 Black et al. ..... 417/222
4,108,577 8/1978 Brucken et al. ..... 417/222
4,425,837 1/1984 Livesay ..... 417/269
4,886,423 12/1989 Iwanami et al. ..... 417/222

FOREIGN PATENT DOCUMENTS 4-94470 3/1992 Japan .

*Primary Examiner*—Richard A. Bertsch
*Assistant Examiner*—Peter Korytnyk
*Attorney, Agent, or Firm*—Cushman, Darby & Cushman

[57] ABSTRACT

A variable capacity swash plate type compressor having compression chambers formed on one side of the plungers only, and control chambers for controlling the capacity of the compressor provided on the other side of the plungers. The capacity of the compressor is controlled by adjusting the pressure in the control chambers, whereby the inclination of the swash plate is changed because the force exerted on the plunger by the pressure in the control chamber, i.e., the force moving the swash plate, is changed. Therefore, since the volume of the compression chambers is relatively small, and a higher control pressure can be used, the response and the stability of the capacity control is improved.

11 Claims, 4 Drawing Sheets

VARIABLE CAPACITY SWASH PLATE TYPE COMPRESSOR

BACKGROUND OF THE INVENTION

1. Field of the Invention

The present invention relates to a variable capacity swash plate type compressor suitable for use as a refrigerant compressor for an air conditioning system for a vehicle.

2. Description of the Related Art

As a variable capacity swash plate type compressor there is known a double-headed plunger type compressor in which compression chambers are formed on both sides of reciprocating plungers to thereby conduct a fluid pumping cycle twice for every one reciprocation of the plunger.

FIG. 4 shows an example of the variable capacity swash plate type compressor using such double-headed plungers.

As shown in FIG. 4, a variable inclination rotary swash plate 207 is installed on and is rotated together with a drive shaft 201. The swash plate 207 is also slidably engaged with plungers 209 at the periphery thereof, via sliding shoes 216 and 219. When the swash plate 207 is rotated together with the drive shaft 201, it is also swung back and forth around an axis perpendicular to the drive shaft, to thereby reciprocate the plungers 209 in a direction parallel to the axis of the drive shaft 201. This reciprocation of the plungers causes the fluid to be compressed to be drawn into compression chambers 250, 251 disposed on both ends of the plungers 209, and then the fluid is compressed therein and discharged therefrom.

In the compressor of FIG. 4, the capacity of the compressor is controlled by adjusting a pressure in a control pressure chamber 200, formed on a rear side of a control piston 230, by using a pressure regulating valve 300. Namely, by changing the pressure acting on the rear side of the piston 230, the piston 230 is moved along the drive shaft 201, and accordingly, the axial position of the swash plate 207 is changed in accordance with the change of position of the piston 230.

The swash plate 207 is connected to the drive shaft 201 by a coupling formed by a flat position 265 of the drive shaft 201 and flat plates 270 on the swash plate 207. Namely, a part of the drive shaft 201 has a flat plate shape 265. Also, two flat plates 270 are projected vertically from the swash plate and form a slit therebetween. An elongated hole 266 is formed on the flat portion 265 of the drive shaft. The drive shaft 201 and the swash plate are coupled by inserting said flat portion 265 of the drive shaft into the slit formed between flat plates 270 of the swash plate 207, whereby the rotating torque is transmitted from the drive shaft 201 to the swash plate 207 through the contact between the flat portion 265 and the flat plates 270. The angle of inclination of the swash plate 207 is controlled by a pin 265 fitted to the flat plates 270 of the swash plate 207 and cooperating with the elongated hole 266.

Namely, when the swash plate 207 is moved axially by the piston 230, the pin 280 slides in the elongated hole 266, and the angle of inclination of the swash plate is changed in accordance with the axial position of the swash plate. The shape and position of the elongated hole 266 is determined such that the angle of inclination of the swash plates is changed to maintain the top dead center of the plunger at the side of the compression chamber 250 at a substantially constant position when the axial position of the swash plate is changed.

By this arrangement, the position of the top dead center of the plunger at compression chamber 250 remains substantially the same when the stroke of the plunger i.e., the capacity of the compressor, is changed.

Since the compression chambers can be formed on both sides of the plungers, the double-headed type plungers are advantageous for an enlarging of the capacity of the swash plate type compressors, and consequently, the variable capacity swash plate type compressors using double-headed type plungers are suitable for use for the air conditioning system of larger size vehicles.

Recently, however, the air conditioning systems have become also commonly used for smaller size vehicles, and in the air conditioning systems for smaller size vehicles, the variable capacity compressors are required to have a smaller size and capacity.

To reduce the size and the capacity of the swash plate type compressor, single-headed plungers having compression chambers formed on one side thereof only are used. Namely, in the variable capacity compressors using the single-headed plungers, usually the capacity of the compressor can be controlled by adjusting the pressure in the crank chamber, and therefore, the provision of the control pressure chamber 200 and the piston 230 shown in FIG. 4 can be eliminated, to thereby achieve a reduction of the size of the compressor. Further, since the compression chambers are formed on only one end, the force biasing the single-headed plunger and the swash plate towards the compression chambers can be controlled by adjusting the pressure in the crank chamber (i.e., the pressure exerted on the rearside of the plunger). Therefore, the stroke of the plunger can be controlled by adjusting the axial position and the angle of inclination of the swash plate in accordance with that biasing force, using a pin (280) and an elongated guide hole (266) arrangement similar to that shown in FIG. 4.

Nevertheless, several problems have arose in the variable capacity swash plate type compressors using single headed plungers.

For example, because of the large volume of the crank chamber, a longer time is required to adjust the pressure in the crank chamber to a desired value, and therefore, the response of the capacity control is slower.

Also the pressure in the crank chamber cannot be arbitrarily set, due to the limitations imposed by the reaction force on the plunger, the friction force of the parts, and the strength of the spring, etc., and therefore, the pressure in the crank chamber usually can be adjusted only within a small range close to the suction pressure of the compressor. This further worsens the response and the accuracy of the capacity control.

Also, the conventional double-headed plunger is in contact with the wall of the compression chamber at the peripheries of both ends of the plunger. Therefore, the moment transferred from the swash plate, which acts to incline the plungers, can be received at both ends of the plunger, whereby a large span between the load bearing points is obtained to reduce a radial load caused by the moment transferred from the swash plate.

In the case of the single-headed plunger, however, the compression chamber is formed on only one side of the plunger, and consequently, the load caused by the moment transferred from the swash plate is received by this end of the plungers only. This imposes a larger radial load on the sliding surface of the cylinder bores and the plungers, and accordingly, reduces the durability of these parts against wear.

SUMMARY OF THE INVENTION

In view of the problems of the related art, the object of the invention is to improve the response and the accuracy of the capacity control, and to improve the durability of the sliding portions of the plunger and cylinder wall of the variable capacity swash plate type compressor using single-headed type plungers, without losing the advantages thereof, such as a compact and simple construction.

According to the present invention, there is provided a variable capacity swash plate type compressor comprising an axially extended cylinder block having a crank chamber and a plurality of axial cylinder bores, a drive shaft rotatably held by the cylinder block, a variable inclination rotary swash plate installed on the drive shaft, a plurality of reciprocating plungers fitted in the cylinder bores and slidably engaged with the swash plate to thereby reciprocate in the cylinder bores at a stroke determined by the angle of inclination of the swash plate when the swash plate is rotated with the drive shaft, compression chambers formed between one end of the plungers and the walls of the cylinder bores, and a capacity control means including control chambers formed between the walls of the cylinder bores and the ends of the plungers opposite to the compression chambers, and a pressure control means for controlling the pressure in the control chambers. The capacity of the compressor is controlled by adjusting the pressure in the control chambers to, thereby adjust the force urging the plungers toward the compression chambers.

BRIEF DESCRIPTION OF THE DRAWINGS

The present invention will be better understood from the description as set forth hereafter, with reference to the accompanying drawings in which.

DESCRIPTION OF THE PREFERRED EMBODIMENTS

Figure 1:
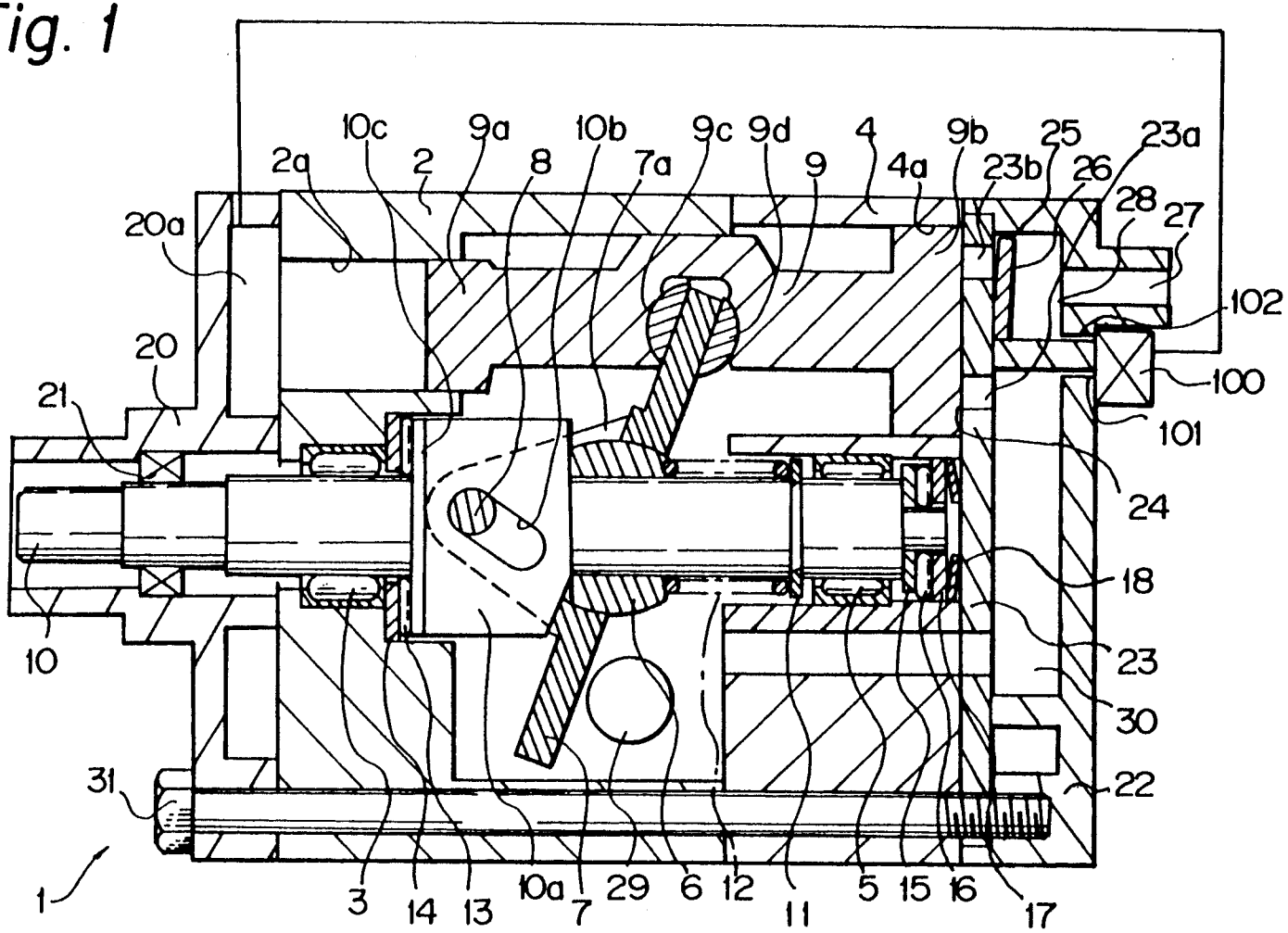
FIG. 1 is a sectional view of the variable capacity swash plate type compressor showing an embodiment of the present invention.

FIG. 1 is a longitudinal sectional view of the variable capacity swash plate type compressor according to the present invention.

In FIG. 1, the compressor 1 comprises a front housing 20, a front cylinder block 2, a rear cylinder block 4, a side plate 23 and rear cover 22, all of which are made of aluminum alloy and we coupled to each other by a plurality of fastening bolts 31.

The reference numeral 10 designates a drive shaft rotatably held by radial bearings 3 of the front cylinder block 2, and 5 of the rear cylinder block 4. The drive shaft 10 is driven by the vehicle engine via a magnetic clutch (not shown).

A plurality of cylinder bores 4*a* (i.e. compression chambers) are formed in the rear cylinder block 4 on a circumference of a circle centered on the axis of the drive shaft 10. Similarly, a plurality of cylinder bores 2*a* (i.e., control chambers) are formed in the front cylinder 2 on the circumference of the same circle as the cylinder bores 4*a*.

The respective cylinder bores 2*a* and 4*a* are aligned with each other in parallel to the axis of the drive shaft, and opposite heads 9*a*, 9*b* of plungers 9 are slidably fitted in the cylinder bores 2*a* and 4*a* respectively.

A swash plate 7 is installed on the drive shaft 10 via a spherical bush 6. The spherical bush 6 is fitted onto the drive shaft 10 so that it is able to slide on the drive shaft 10 along the axis thereof. The inner surface of the center bore of the swash plate 7, which is engaged with the outer surface of the spherical bush 6, has a concave spherical shape complementary to the outer surface of the spherical bush 6, and thus the swash plate 7 can be positioned at any arbitrary inclination relative to the drive shaft 10.

A coupling portion 7*a*, comprises two flat plates arranged in parallel and forming a slit therebetween, is provided on the front side of the swash plate 7. Also, a flat portion 10*a* is provided on the drive shaft 10. The portion 10*a* of the drive shaft 10 is inserted in the slit of the coupling portion 7*a* of the swash plate, and accordingly, the rotation of the drive shaft 10 is transferred to the swash plate 7 by the engagement of the flat portion 10*a* of the drive shaft and the coupling portion 7*a* of the swash plate 7.

The flat portion 10*a* of the drive shaft 10 and the coupling portion 7*a* of the swash plate are coupled by an elongated guide hole 10*b* formed in the flat plate 10*a* and a guide pin 8 fixed to the flat plates of the coupling portion 7*a*. The flat plate 10*a* of the drive shaft and the coupling portion 7*a* of the swash plate 7 are allowed to slide relative to each other along the direction of the longitudinal axis of the elongated guide hole 10*b*.

Consequently, when the spherical bush 6 and the swash plate 7 move axially along the drive shaft 10, the swash plate 7 is turned around the spherical bush 6 by the engagement of the pin 8 of the coupling portion 7*a* and the guide 10*b* of the flat plate 10*a*, whereby the angle of inclination of the swash plate 7 is adjusted in accordance with the axial position of the swash plate 7 and the spherical bush 6 on the drive shaft 10.

The plungers 9 are slidably engaged with the periphery of the swash plate 7 via spherical shoes 9*c*, 9*d*. The spherical shoes 9*c*, 9*d* maintain a close contact between the plungers 9 and the swash plate 7 when the angle of inclination of the latter is changed.

When the swash plate 7 is rotated with the drive shaft 10, the rotation of the swash plate 7 is converted to the reciprocating motion of the plungers 9, due to the sliding contact between the plungers 9 and the swash plate 7. The fluid to be compressed is drawn into the compression chamber 4*a*, compressed therein and discharged therefrom, by the reciprocation of the plungers 9. The reciprocation stroke of the plungers 9 is determined by the angle of inclination of the swash plate 7, and therefore, the capacity of the compressor (i.e., the reciprocation stroke of the plungers) is changed when the angle of inclination of the swash plate 7 is changed, as explained before, in accordance with the axial position of the swash plate 7. The shape of the elongated guide hole 10*b* of the flat plate 10*a* is determined such that the angle of inclination of the swash plate 7 is changed in accordance with the axial position thereof, to thereby maintain the top dead centers of the plungers 9 at a constant position even when the axial position of the swash plate 7 is changed. In theory, the elongated guide hole 10*b* must have a curved configuration to provide the above function, but in practice, a straight elongated hole may be used, to approximate this function.

Reference numeral 11 represents a stopper ring fixed on the drive shaft 10. A compression spring 12 is installed between the stopper ring 11 and the spherical bush 6, to urge the spherical bush 6 toward the front housing 20.

Reference numerals 13 and 16 represent thrust bearings receiving thrust loads exerted on the drive shaft 10. The thrust bearing 13 is installed on the front cylinder block 2 via a thrust washer 14, and is in contact with the thrust collar 10*c* of the drive shaft 10. The thrust bearing 16 is installed between the end of the drive shaft 10 and the rear side plate 23, and is secured by thrust washers 15 and 17 and a compression spring 18. The spring 18 also functions to urge the drive shaft toward the front cylinder block 2, to thereby hold the drive shaft 10 in the predetermined position.

Reference numeral 21 designates a sealing member disposed on the front housing 20 at the portion the drive shaft 10 penetrating the front housing 20, to prevent a leakage of lubricant or refrigerant therefrom.

An annular chamber 20*a* is formed in the front housing 20, and is communicated with the respective control chambers 2*a* of the front cylinder block 2.

The respective compression chambers 4*a* of the rear cylinder block 4 are connected to a suction chamber 30 and a discharge chamber 28 formed in the rear housing 22, via suction ports 23*a* and discharge ports 23*b* formed on the rear side plate 23 respectively. A suction valve 24 is provided on the respective suction ports 23*a*, and a discharge valve 25 and valve holder 26 are provided on the respective discharge ports 23*b*, to thereby draw the refrigerant into the respective compression chambers, and to discharge it therefrom, in accordance with the reciprocation of the plungers 9. The refrigerant is supplied to the suction chamber 23 through an inlet port 29 and the crank chamber. Also, the compressed refrigerant is fed to the air conditioning equipment from the discharge chamber 28, through an outlet port 27.

A pressure regulating valve 100 is installed on the rear cover 22 of the compressor, and is connected to the suction chamber 30 and the discharge chamber 28 by passages 101 and 102 respectively. The output of the pressure regulating valve 100 is led to the annular chamber 20*a* of the front housing 20 via a passage 103. The output pressure of the regulating valve 100 can be arbitrarily set within a range between the suction pressure and discharge pressure, and therefore, the pressure in the control chambers 2*a*, which are in communication with the annular chambers 20*a*, also can be arbitrarily set within the same range.

The operation of the variable capacity swash plate type compressor of the present invention is now described.

FIG. 1 shows the maximum capacity condition of the compressor, in which the angle of inclination of the swash plate 7 is at a maximum.

As explained before, the angle of inclination of the swash plate 7 is automatically set by the engagement of the elongated guide hole 10*b* and the pin 8 in accordance with the axial position of the spherical bush 6. The axial position of the spherical bush 6 is determined as a position in which the force exerted on the spherical bush 6 by the compression spring 12, and the force transferred to the spherical bush 6 from the plungers 9 through the swash plate 7, are balanced.

Since the top dead center of the compression stroke of the plunger 9 is maintained at a constant position regardless of the position and inclination of the swash plate 7, the average pressure acting on the heads 9*b* of the plungers 9 through the operation cycles becomes approximately equal to an average of the suction and discharge pressures. Consequently, if the suction and discharge pressures of the compressor are kept at a constant value, the force acting on the head 9*b* of the plungers 9 also has a constant value.

On the other hand, forces imposed by the pressure in the control chamber 2*a* are exerted on the heads 9*a* of the opposite ends of the plungers 9, and therefore, the force transferred to the spherical bush 6 from the plungers 9 through the swash plate 7 is a total of the forces acting on the head 9*b* (constant) and the force acting on the head 9*a*. Consequently, the axial position of the spherical bush 6, i.e., the inclination of the swash plate 7, can be adjusted by changing the force transferred from the plungers to the spherical bush by adjusting the pressure in the control chambers, using the pressure regulating valve 100.

Further, by setting the pressure in the control chamber 2*a* such that the force acting on the head 9*a* approximately balances the compression force acting on the head 9*b*, the resilent force of the spring 12 can be minimized. Therefore, the resilent force of the spring 12 can be set such that the spring 12 supplies only the force required for compensating the friction loss between the spherical bush 6 and the drive shaft 10 when the bush 6 is moved toward the front housing 20. Therefore, by reducing the resilent force of the spring 12, the thrust load acting on the thrust bearing 16 is also reduced, and thus the durability of the thrust bearing 16 is improved.

Figure 2:
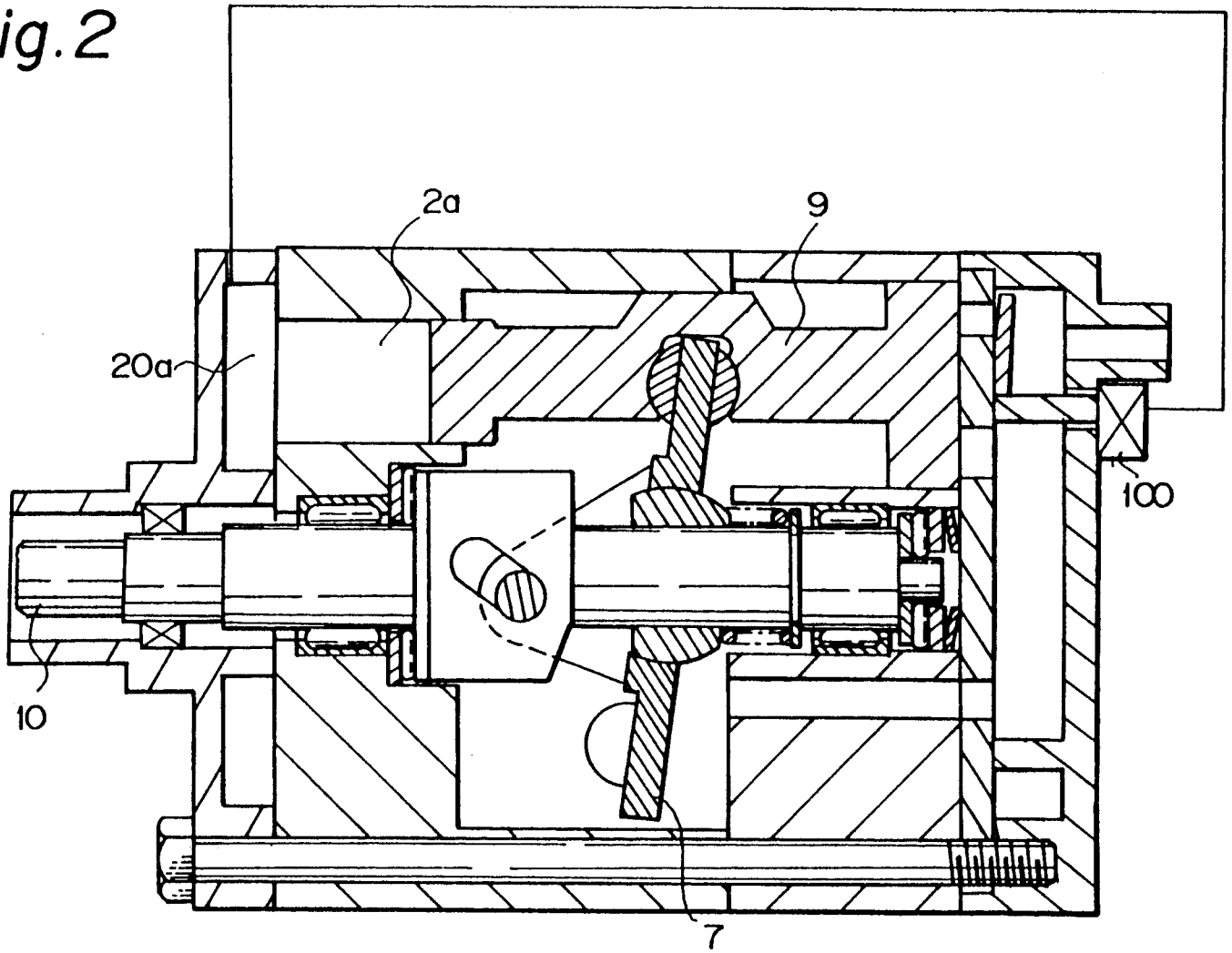
FIG. 2 is a sectional view similar to FIG. 1, but showing the condition in which the capacity of the compressor is changed.

In the maximum capacity condition as shown in FIG. 1, the pressure in the control chamber 2*a* is reduced to a value close to the suction pressure. FIG. 2, however, shows the minimum capacity condition of the compressor, in which the pressure in the control chamber 2*a* is increased to a value close to the discharge pressure and the inclination of the swash plate 7 is set at a minimum.

In this embodiment, the following advantage is obtained by controlling the pressure in the control chamber instead of the pressure in the crank chamber.

Namely, since the total volume of the annular chamber 20*a* and the control chambers 2*a* is much smaller than the volume of the crank chamber, the time required for changing the pressure of the control chambers 2*a* by the pressure regulating value 100 is much shorter, in comparison with the time required to change the pressure in the crank chamber, and therefore, a quick capacity control response is obtained.

Further, the diameters of the heads 9*a* and the bore of the control chambers 2*a* can be arbitrarily set in this embodiment, and therefore, desired control characteristics of the capacity control, such as stability and accuracy, can be obtained. For example, if the diameters of the heads 9*a* and the control chambers 2*a* are made smaller, a higher pressure is required in the control chamber to obtain the same angle of inclination of the swash plate. This means that a wider range of the pressure in the control chambers 2*a* can be used for the same capacity control range.

Figure 3:
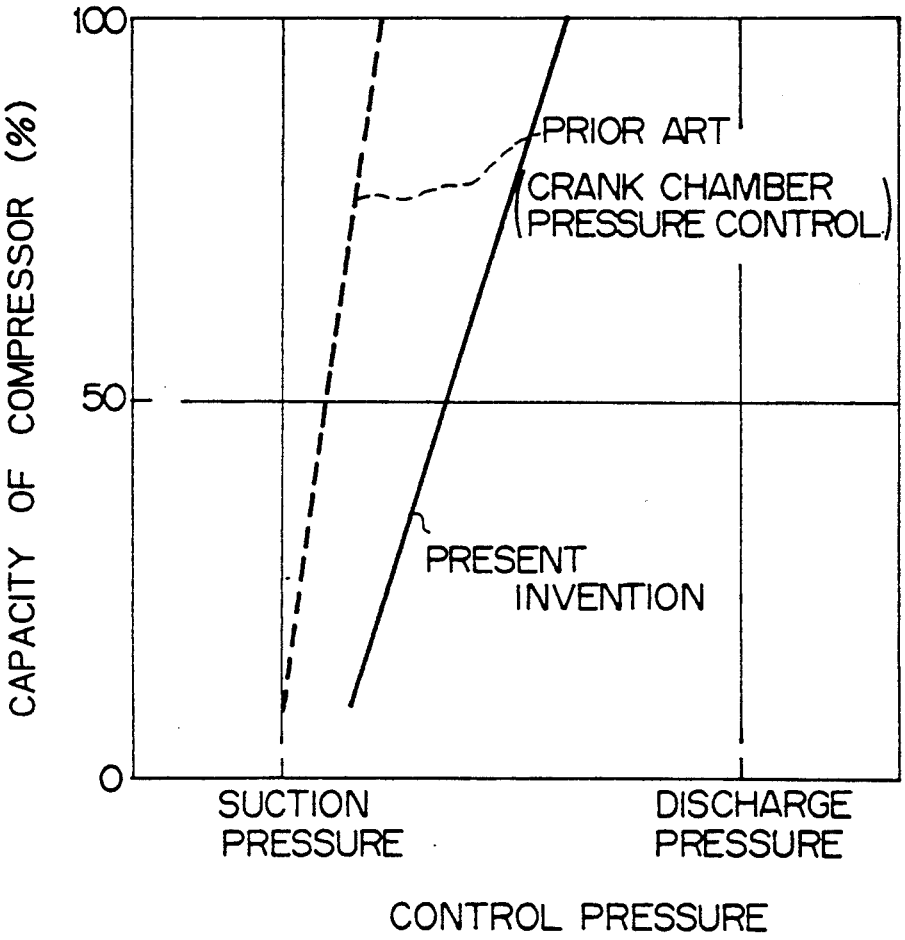
FIG. 3 is a diagram showing the relationship between the control pressure and the capacity of the compressor.
Figure 4:
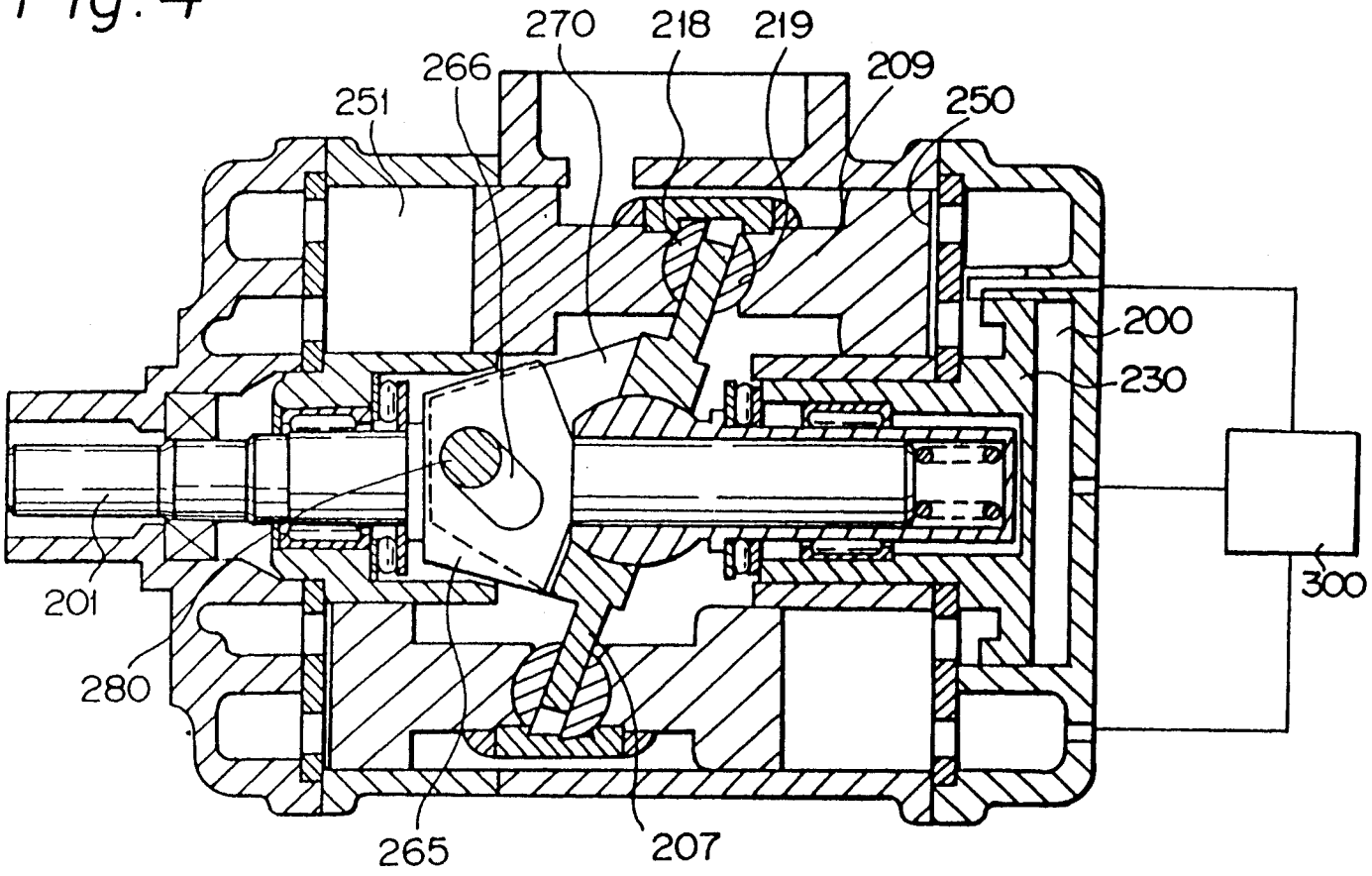
Fig. 4 PRIOR ART
FIG. 4 is a sectional view of the conventional variable capacity swash plate type compressor with double-headed plungers.

FIG. 3 shows examples of the relationships between the compressor capacity and the pressure in the control chambers. The dotted line shows the case of a conventional crank chamber pressure control, and the solid line shows the present invention. As seen from FIG. 3, not only is the sensitivity of the compressor capacity to the control pressure i.e., the accuracy of the capacity control, improved by the present invention, but also the stability of the control is increased by the present invention, since a higher control pressure is used.

Further, since the plungers 9 in the present invention are in contact with the cylinder bores at both ends 9*a*, 9*b* thereof, the radial load received by each contacting portion thereof is approximately a half of that of the single-headed plunger type compressors. Therefore, the durability of the plungers and cylinder bores against wear is greatly improved.

As explained above, according to the present invention, the response and the accuracy of the capacity control and durability against wear of the plungers are improved by controlling the pressure in the control chambers provided on opposite side of the compression chambers of the single-headed plunger, to thus control the capacity of the compressor.

We claim:

1. A variable capacity swash plate type compressor comprising:

an axially extended cylinder block having a crank chamber formed therein and a plurality of axial cylinder bores disposed on the circumference of said crank chamber;

a drive shaft rotatably held by said cylinder block such that an axis thereof is axially extended through said crank chamber;

a variable inclination rotary swash plate installed on the drive shaft so that said swash plate is allowed to turn around an axis perpendicular to said drive shaft, to thereby vary an angle of inclination of said swash plate;

a plurality of reciprocating plungers fitted in said cylinder bores of said cylinder block and slidably engaged with said swash plate, whereby a reciprocating motion of said plungers, in which the stroke of the plungers is determined by the angle of inclination of said swash plate, is generated when said swash plate is rotated with the drive shaft;

compression chambers defined by first ends of said plungers and the walls of said cylinder bores, for drawing in and discharging a fluid to be compressed, by a reciprocation of said plungers; and, capacity control means comprising, control chambers defined by the walls of said cylinder bores and second ends of said plunger which are opposite to said first ends of the plungers defining said compression chambers, said second ends slidably and sealingly engaging the walls of the cylinder bores, and a pressure control means for controlling a pressure in said control chambers, said capacity control means controlling the capacity of the compressor by adjusting a pressure in said control chambers to thereby adjust a force urging said plungers toward said compression chambers, said control chambers being isolated from said crank chamber.

2. A variable capacity swash plate type compressor according to claim 1, wherein said capacity control means comprises;

a positioning means for changing an axial position of the swash plate relative to said drive shaft in accordance with a force exerted by the plungers on the swash plate for urging the swash plate along the drive shaft; and, an angular positioning means for changing an angle of inclination of the swash plate in accordance with an axial position thereof on the drive shaft.

3. A variable capacity swash plate type compressor according to claim 2, wherein said angular positioning means adjusts the angle of inclination of said swash plate in accordance with the axial position thereof such that the top dead center of said plunger compression stroke relative to the cylinder block is maintained at a constant position when the axial position of said swash plate is changed.

4. A variable capacity swash plate type compressor according to claim 1, wherein the diameter of said plungers at the compression chamber side ends is different from the diameter of said plungers at the control chamber side ends.

5. A variable capacity swash plate type compressor according to claim 4, wherein the diameter of said plungers at the compression chamber side ends is larger than the diameter of said plungers at the control chamber side ends.

6. A variable capacity swash plate type compressor according to claim 1, wherein said pressure control means for controlling the pressure in said control chambers is a pressure regulating valve that utilizes the suction and discharge pressure of the compressor for adjusting the pressure in said control chambers.

7. A variable capacity swash plate type compressor according to claim 6, wherein said pressure regulating valve is mounted on the housing of the compressor on said compression chamber side.

8. A variable capacity swash plate type compressor according to claim 7, wherein the output pressure of said regulating valve is directly fed to said control chambers.

9. A method of controlling a capacity of a variable capacity swash plate type compressor having an axially extended cylinder block with a crank chamber and a plurality of axial cylinder bores formed therein, a drive shaft rotatably held by said cylinder block such that an axis thereof is axially extended through said crank chamber, a variable inclination rotary swash plate installed on said drive shaft, a plurality of reciprocating plungers fitted in said cylinder bores of said cylinder block and slidably engaged with said swash plate to be thereby reciprocated in said cylinder bores for a stroke determined by an angle of inclination of said swash plate, and compression chambers defined by first ends of said plungers and the walls of said cylinder bores, for drawing in and discharging a fluid to be compressed, in accordance with the reciprocating motion of said plungers, the method comprising the step of:

controlling the capacity of the compressor by adjusting a pressure exerted on second ends of the plungers which are opposite to said first ends, said second ends slidably and sealingly engaging the walls of said cylinder bores defining control chambers, said control chambers being isolated from said crank chamber.

10. A method of controlling a capacity of a variable capacity swash plate type compressor according to claim 9, further comprising the steps of:

adjusting the axial position of said swash plate on the drive shaft in accordance with a force exerted on said second ends of the plungers by the pressure in said control chambers; and adjusting the angle of inclination of said swash plate in accordance with said axial position thereof on the drive shaft.

11. A method of controlling a capacity of a variable capacity swash plate type compressor according to claim 10, wherein the angle of inclination of said swash plate is adjusted in accordance with the axial position thereof, so that the top dead center of said plunger compression stroke relative to the cylinder block is maintained at a constant position when the axial position of said swash plate is changed.

* * * * *